US007212880B2

(12) United States Patent
Mizuno et al.

(10) Patent No.: US 7,212,880 B2
(45) Date of Patent: May 1, 2007

(54) EMBROIDERY DATA PROCESSING DEVICE AND COMPUTER PROGRAM PRODUCT

(75) Inventors: Masahiro Mizuno, Nagoya (JP); Shoichi Taguchi, Nagoya (JP); Yukiyoshi Muto, Nagoya (JP); Mikitoshi Suzuki, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/475,031

(22) Filed: Jun. 27, 2006

(65) Prior Publication Data

US 2007/0032899 A1 Feb. 8, 2007

(30) Foreign Application Priority Data

Jul. 12, 2005 (JP) ..... 2005-203392

(51) Int. Cl.

| | |
|---|---|
| ***D05C 5/02*** | (2006.01) |
| ***D05C 17/00*** | (2006.01) |
| ***G05B 15/00*** | (2006.01) |
| ***D05B 21/00*** | (2006.01) |
| ***D05B 19/00*** | (2006.01) |

(52) U.S. Cl. ..... 700/138; 700/83; 112/102.5; 112/439; 112/470.04; 112/470.07; 112/475.19

(58) Field of Classification Search ..... 700/17, 700/83, 117, 130, 136, 138; 112/2, 78, 102.5, 112/400, 402, 439, 470.01, 470.04, 470.06, 112/470.07, 475.01, 475.17, 475.18, 475.19; 428/906.6

See application file for complete search history.

(56) References Cited

U.S. PATENT DOCUMENTS

| | | | | |
|---|---|---|---|---|
| 4,758,960 | A * | 7/1988 | Jung | 700/134 |
| 4,774,778 | A * | 10/1988 | Williams | 38/102.2 |
| 4,953,485 | A * | 9/1990 | Brower et al. | 112/475.05 |
| 4,998,489 | A * | 3/1991 | Hisatake et al. | 112/103 |
| 5,072,680 | A * | 12/1991 | Nakashima | 112/445 |
| 5,333,111 | A * | 7/1994 | Chaiken et al. | 700/135 |
| 5,438,520 | A | 8/1995 | Satoh et al. | |
| 6,012,402 | A * | 1/2000 | Sekine | 112/102.5 |
| 6,859,679 | B1 * | 2/2005 | Smith et al. | 700/138 |
| 6,875,395 | B2 * | 4/2005 | Kisha et al. | 264/482 |
| 7,069,871 | B2 * | 7/2006 | Widell et al. | 112/475.19 |
| 7,140,312 | B2 * | 11/2006 | Yamada | 112/470.05 |
| 2005/0182508 | A1 * | 8/2005 | Niimi et al. | 700/138 |
| 2005/0256603 | A1 * | 11/2005 | Cloud et al. | 700/132 |

FOREIGN PATENT DOCUMENTS

| | | | |
|---|---|---|---|
| EP | 853154 | A2 * | 7/1988 |
| GB | 2341529 | A * | 3/2000 |
| JP | 05228281 | A * | 9/1993 |
| JP | A-06-294065 | | 10/1994 |
| JP | 2000187683 | A * | 7/2000 |

* cited by examiner

*Primary Examiner*—Crystal J. Barnes
(74) *Attorney, Agent, or Firm*—Oliff & Berridge, PLC

(57) ABSTRACT

The invention presents an embroidery data processing device and a computer program product capable of easily forming images of finished state of applique even if the fabric for applique is a pattern fabric. A selected fabric image of fabric for applique is displayed, and when the user manipulates the mouse, and moves the cursor to a desired position of the fabric image, and clicks by a specified number of times, the applique pattern preliminarily inputted through the image scanner is displayed at the position of the cursor (S101 to S103). When the user clicks the preview button by the mouse, only the fabric image within the applique pattern is extracted, and an applique image is displayed, and an applique sewing stitch image is overlaid and displayed on the applique image (S104 to S109).

10 Claims, 9 Drawing Sheets

EMBROIDERY DATA PROCESSING DEVICE AND COMPUTER PROGRAM PRODUCT

CROSS-REFERENCE TO RELATED APPLICATIONS

This application claims priority from JP 2005-203392, filed on Jul. 12, 2005, the contents of which are hereby incorporated by reference.

TECHNICAL FIELD

The disclosure relates to an embroidery data processing device and a computer program product, and more particularly to an embroidery data processing device and a computer program product capable of creating applique sewing data for sewing applique of an inputted applique pattern on a fabric.

BACKGROUND

Hitherto, various ideas have been proposed About an embroidery data processing device and a computer program product for creating applique sewing data for sewing applique of an inputted applique pattern on a fabric.

For example, a proposed embroidery data processing device for creating applique sewing data comprises a fabric piece for applique having an intersection of two curves, a fabric, and satin stitches for sewing the fabric piece for applique on the fabric, in which a virtual line linking an intersection of inner periphery of one curve and other curve of satin stitches for sewing the two curves and an intersection of outer periphery is a border line of one curve and other curve, and the stitch direction of the one curve and the other curve is gradually changed along the border line near the border line (see, for example, Japanese patent application laid-open No. H6 (1994)-294065 (paragraphs [0010] to [0035], and FIGS. 1 to 14).

Such conventional embroidery data processing device, however, can display the inputted applique pattern in the display, and automatically create cutting data or sewing data for applique on the basis of the applique pattern, but when the fabric for applique is a pattern fabric, it is hard to distinguish the size or shape of the pattern of fabric piece for applique being cut along the cutting data.

SUMMARY

The disclosure has been made in view of the above circumstances and has an object to overcome the above problems and to provide an embroidery data processing device and a computer program product capable of displaying a finished sewn state of fabric piece for applique being cut in an inputted applique pattern, so that an image of finished state of applique is shown easily even if the fabric for applique is a pattern fabric.

To achieve the above object, there is provided an embroidery data processing device comprising: a shape input device that inputs an applique pattern; an applique sewing data creating device that creates applique sewing data for sewing applique of the applique pattern on a fabric; a fabric image data input device that inputs fabric image data of the fabric for the applique; a fabric image display device that displays a fabric image on the basis of the fabric image data inputted by the fabric image data input device; an applique pattern display device that overlays and displays the applique pattern on the fabric image; and an applique image display device that extracts only the fabric image within the applique patterned overlaid on the fabric image out of the fabric image and displaying as an applique image, and displays an applique stitch image for sewing the applique on the basis of the applique sewing data by overlaying on the applique image.

In this embroidery data processing device, by inputting an applique pattern and inputting fabric image data of a fabric for applique, the fabric image is displayed. On the basis of the inputted applique pattern, applique sewing data is created. The inputted applique pattern is displayed on the fabric image. Only the fabric image within the applique pattern is extracted and displayed as an applique image. An applique stitch image for sewing applique according to the applique swing data is overlaid and displayed on the applique image.

As a result, by inputting the applique pattern and inputting the fabric image data of the fabric for applique, a finished sewn state of the applique fabric piece being cut in the inputted applique pattern from the fabric for applique is displayed, and the user easily obtains the image of finished state of applique even if the fabric for applique is a pattern fabric.

To achieve the above object, there is also provided a computer program product used and executed in an embroidery data processing device comprising: a computer readable recording medium; and a computer program stored in the computer readable recording medium, wherein the computer program includes: a shape input step of inputting an applique pattern; an applique sewing data creating step of creating applique sewing data for sewing applique of the applique pattern on a fabric; a fabric image data input step of inputting fabric image data of the fabric for the applique; a fabric image display step of displaying a fabric image on the basis of the fabric image data inputted in the fabric image data input step; an applique pattern display step of overlaying and displaying the applique pattern on the fabric image; and an applique image display step of extracting only the fabric image within the applique patterned overlaid on the fabric image out of the fabric image and displaying as an applique image, and displaying an applique stitch image for sewing the applique on the basis of the applique sewing data by overlaying on the applique image.

In this computer program product, the computer reads a program recorded in the computer program product, and displays the fabric image according to the inputted fabric image data of the fabric for applique. The computer also displays the inputted applique pattern on the fabric image. The computer extracts only the fabric image within the applique pattern, and displays as the applique image. According to the inputted applique pattern, the computer creates the applique sewing data, and displays the applique stitch image for sewing applique according to the applique sewing data by overlaying on the applique image.

As a result, by inputting the applique pattern and inputting the fabric image data of the fabric for applique, a finished sewn state of the applique fabric piece being cut in the inputted applique pattern from the fabric for applique is displayed, and the user easily obtains the image of finished state of applique even if the fabric for applique is a pattern fabric.

DETAILED DESCRIPTION

A detailed description of an exemplary embodiment of an embroidery data processing device and a, computer program product embodying the disclosure will now be given referring to the accompanying drawings. An outline of the embroidery data processing device of the exemplary embodiment is explained with reference to FIG. 1.

Figure 1:
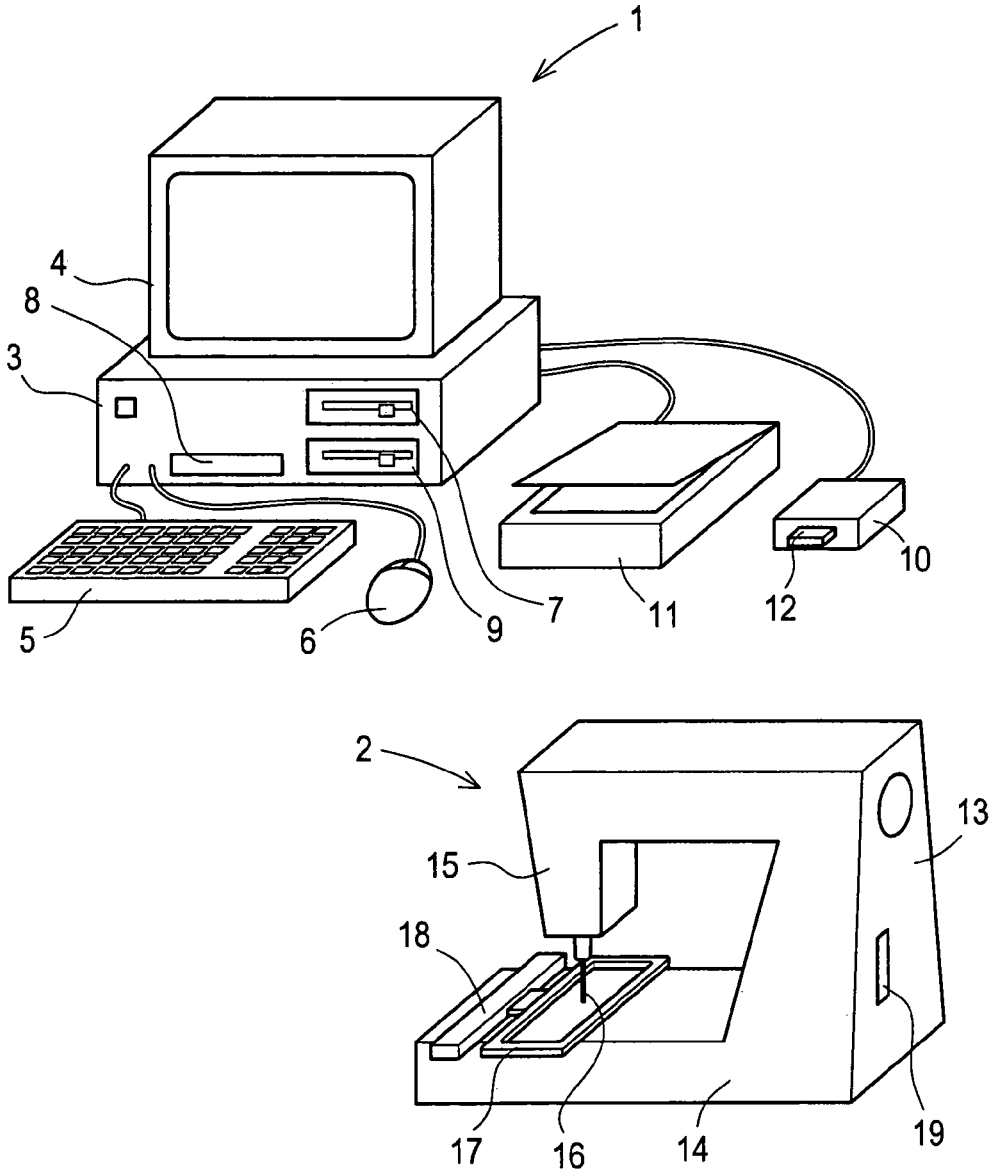
FIG. 1 is a perspective view of an outline of an embroidery data processing device in an exemplary embodiment.

In FIG. 1, an embroidery data processing device 1 mainly comprises a control main body 3. The control main body 3 has a CRT display 4 for displaying an image, a pattern, a text and the like. The control main body 3 also includes a keyboard 5, a mouse 6, a flexible disk (FD) device 7, a hard disk drive 8, a CD-ROM device 9, a flash memory device 10, and an image scanner 11.

In the FD device 7, a flexible disk 7A (see FIG. 2) is detachably loaded as recording medium storing various programs, including an applique preview processing program described below. The hard disk drive 8 stores image data of various fabrics, various applique patterns, outline data, applique sewing data, embroidery data and others in the hard disk, or reads them out from the hard disk. The CD-ROM device 9 reads out the image data of various fabrics, various applique patterns, the outline data, and the embroidery data recorded in the CD-ROM. The flash memory device 10 has a detachable memory card 12 such as a nonvolatile flash memory, and is designed to write the applique sewing data and the embroidery data into the memory card 12. The image scanner 11 reads original images, such as the fabric data of a fabric for applique and an applique pattern.

Such programs including the embroidery data processing programs and others described below are recorded in flexible disk 7A, and other computer readable recording media such as a semiconductor memory, a hard disk, a data card (an IC card, a magnetic card, etc.), an: optical disk (a CD-ROM, DVD, etc.), a magneto-optical disk (a MO, etc.), a phase change disk, and a magnetic tape,. and can be used by loading in the computer and starting up as required. Besides, programs mentioned above can be stored in the ROM or a backup RAM, and may be used by loading the ROM or the backup RAM in the computer.

A sewing machine main body 13 of an embroidery machine 2 has an arm 15 formed integrally above a bed 14. The leading end of the arm 15 has a needle bar (not shown) having a sewing needle 16. Above the bed 14, an embroidery frame 17 for holding a fabric (not shown) is disposed. The embroidery frame 17 is designed to be moved to an arbitrary position depending on the own XY coordinate system of the apparatus by means of an embroidery frame moving mechanism 18. By driving the needle bar and a hook mechanism (not shown) while freely moving the fabric by the embroidery frame moving mechanism 18, an embroidery motion is executed on the fabric to form specified stitches and specified embroidery.

Further, at the right side of the sewing machine main body 13, a card slot 19 is provided for loading the memory card 12.

The embroidery frame moving mechanism 18 and the needle bar are controlled by a control device (not shown) composed of a microcomputer and others. In the control device, the applique sewing data and the embroidery data are given from outside by the memory card 12. Therefore, the control device can execute an embroidery forming operation automatically on the basis of the data instructing the moving distance (needle drop point) in XY direction of the fabric stitch by stitch in the applique sewing data and the embroidery data.

Figure 2:
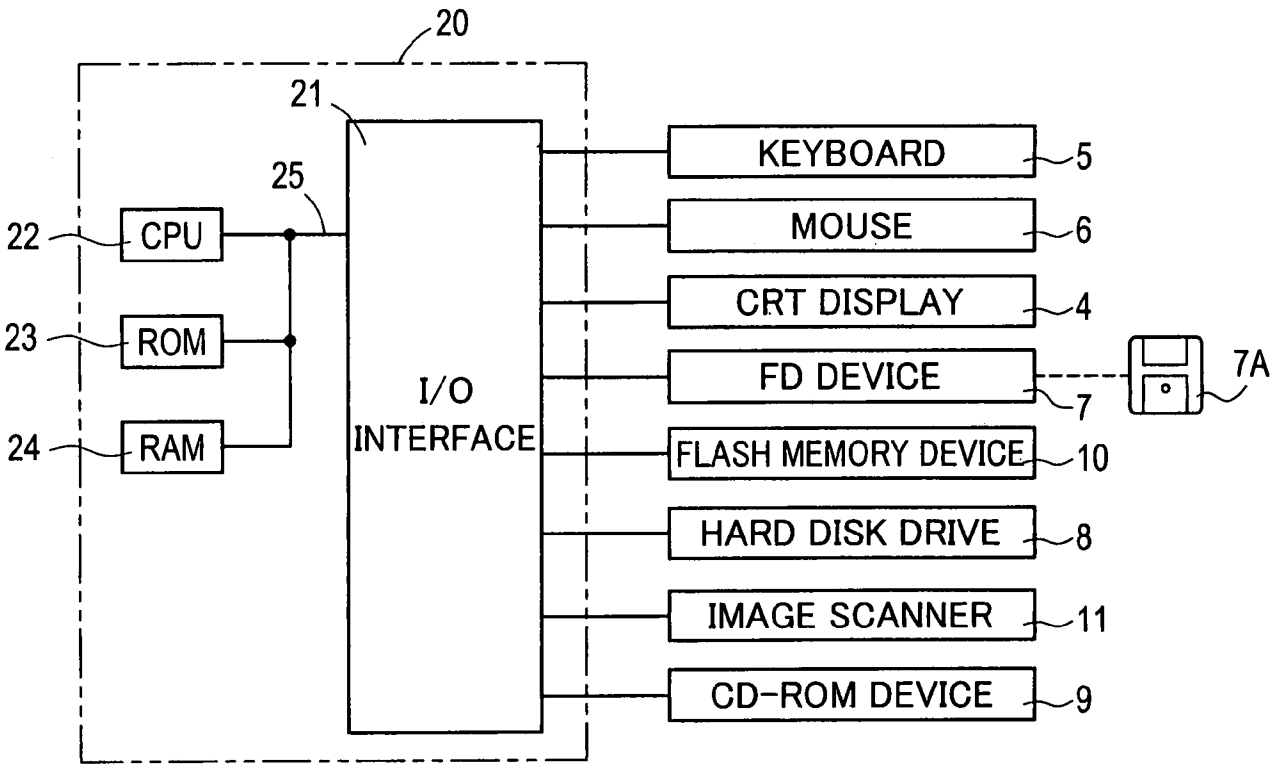
FIG. 2 is a block diagram of a control system of the embroidery data processing device.

An electrical configuration of embroidery data processing device is explained with reference to FIG. 2. FIG. 2 is a block diagram showing a control system of the embroidery data processing device.

In FIG. 2, a control device 20 built in the control main body 3 is mainly composed of a circuit of the microcomputer, and includes an input and output interface 21, a CPU 22, a ROM 23, and a RAM 24 connected mutually through a bus line 25.

The input and output interface 21 is connected to the CRT display 4, the keyboard 5, the mouse 6, the flexible disk (FD) device 7, the flash memory device 10, the hard disk drive 8, the image scanner 11, and the CD-ROM device 9.

In this configuration, the control device 20 reads the applique preview processing program and the embroidery data stored in the flexible disk 7A through the FD device 7, and executes applique preview process according to the read program.

The ROM 23 stores control programs necessary for operating the embroidery data processing device 1, and various programs for processing other embroidery fabric image data of the fabric for applique. The RAM 24 includes a plurality of fabric image data memory areas for storing the fabric image data of the fabrics for applique being read in through the image scanner 11, an applique pattern storage area for storing applique patterns being read in from the original image through the image scanner 11, an applique image data memory area for storing applique image data created on the basis of the applique pattern, an applique sewing data memory area for storing applique sewing data and stitch data for applique cutting created on the basis of the applique pattern, and other necessary data memory areas for creating the applique image data.

In the embroidery data processing device 1 having such configuration, the applique preview process for displaying a finished state of applique by displaying the fabric image of the fabric for applique and overlaying and displaying the applique pattern on the fabric image is explained with reference to FIG. 3 to FIG. 13.

Figure 3:
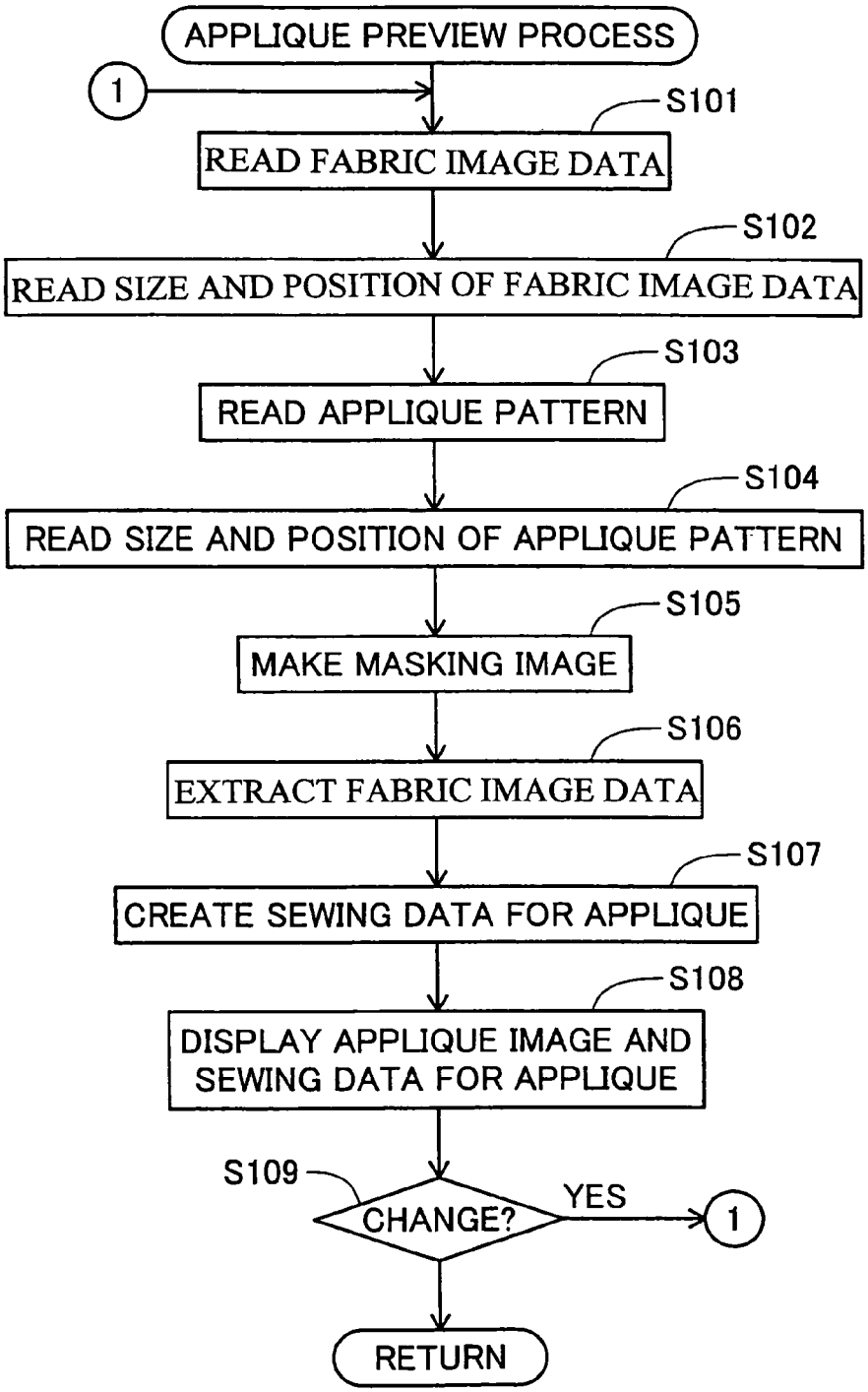
FIG. 3 is a flowchart of an applique preview processing program for displaying a finished state of applique.

As shown in FIG. 3, in step 101 (S101), the CPU 22 reads in the fabric image data of the fabric for applique inputted through the image scanner 11, and stores in the fabric image data memory area of the RAM 24. When instructed to select the fabric image data from the keyboard 5 or the mouse 6, the CPU 22 displays the fabric image selection window 31 (see FIG. 4) for selecting the fabric image data on the CRT display 4, reads out the selected fabric image data from the fabric image data memory area, and stores in the RAM 24.

In S102, the CPU 22 reads in the size of the selected fabric image data, display magnification factor, and a position of the display portion of the fabric image data, through the fabric image selection window 31. When an open button 38 of the fabric image display window 31 is clicked, the CPU 22 displays the selected display portion of the fabric image data in the specified size and magnification factor as a fabric image 41 (see FIG. 5) on the CRT display 4. The CPU 22 also displays a preview button 44 instructing display of a finished state of applique in the upper edge of the CRT display 4.

Figure 4:
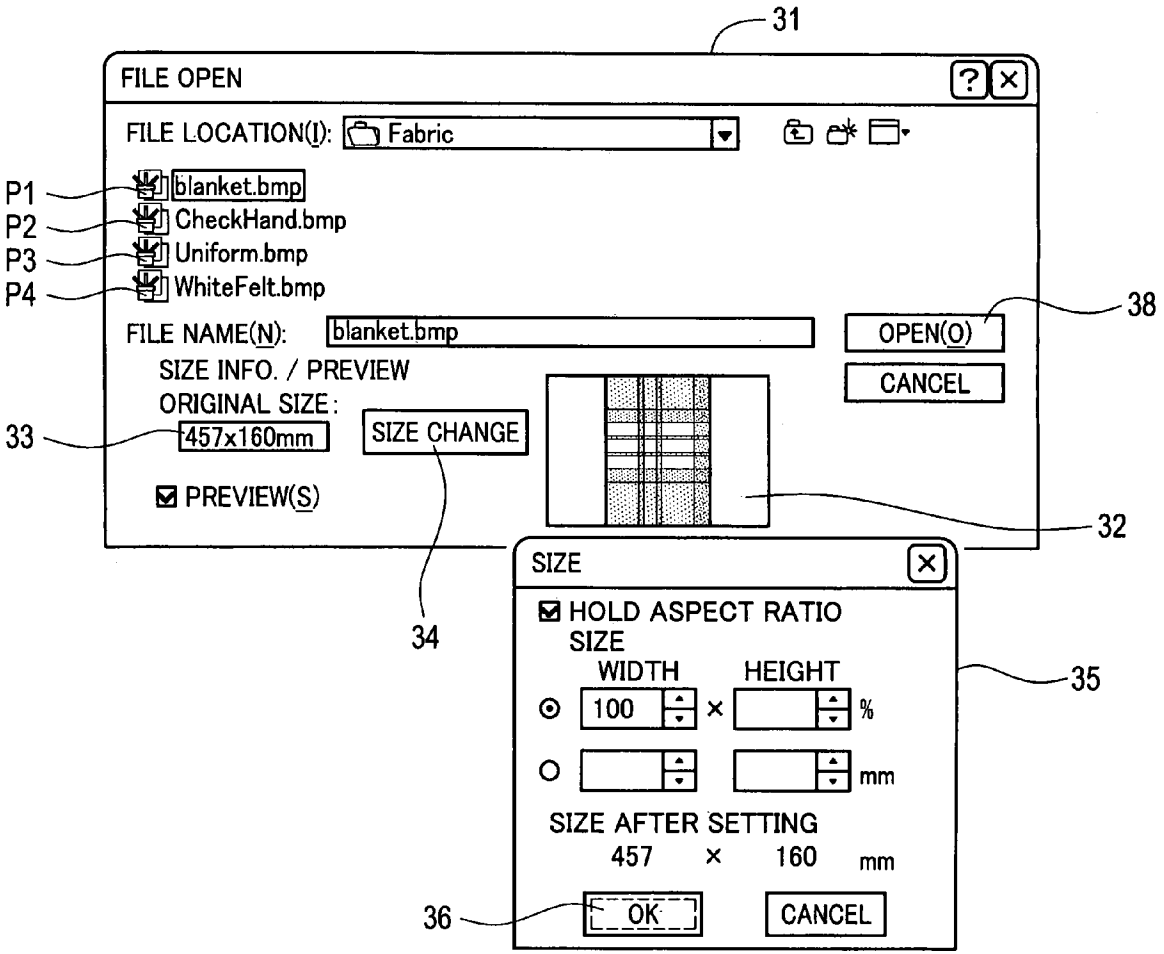
FIG. 4 is a diagram of an example of a fabric image selection window and a size change window.

The fabric image selection window 31 displayed when selecting the fabric image data is explained in FIG. 4.

As shown in FIG. 4, the fabric image selection window 31 displays a plurality of types of selectable fabric image data P1 to P4 stored in the fabric image data memory area. Before the fabric image of the selected fabric image data is actually displayed, it can be checked in a preview area 32.

A size display region 33 is provided for displaying each size including a height and a width of the fabric image displayed on the CRT display 4. At the lateral side of the size display region 33, a size change button 34 is provided for instructing size change of the fabric image. When the user clicks the size change button 34, a size change window 35 is displayed.

In the size change window 35, if "hold aspect ratio" is selected, the CPU 22 maintains the aspect ratio of the fabric image. When "100%" of size width is selected and an OK button 36 is clicked, the CPU 22 displays the width size of the fabric image displayed on the display screen, corresponding to the width size displayed in the size display region 33, and sets the fabric pattern to be displayed in actual size (100%). For example, when "hold aspect ratio" is selected, and "50%" of size width is selected and OK button 36 is clicked, the CPU 22 displays the width size of fabric image displayed on the display screen, corresponding to 2 times of the width size displayed in the size-display region 33, and sets the fabric pattern to be displayed in ½ scale (50%).

Figure 5:
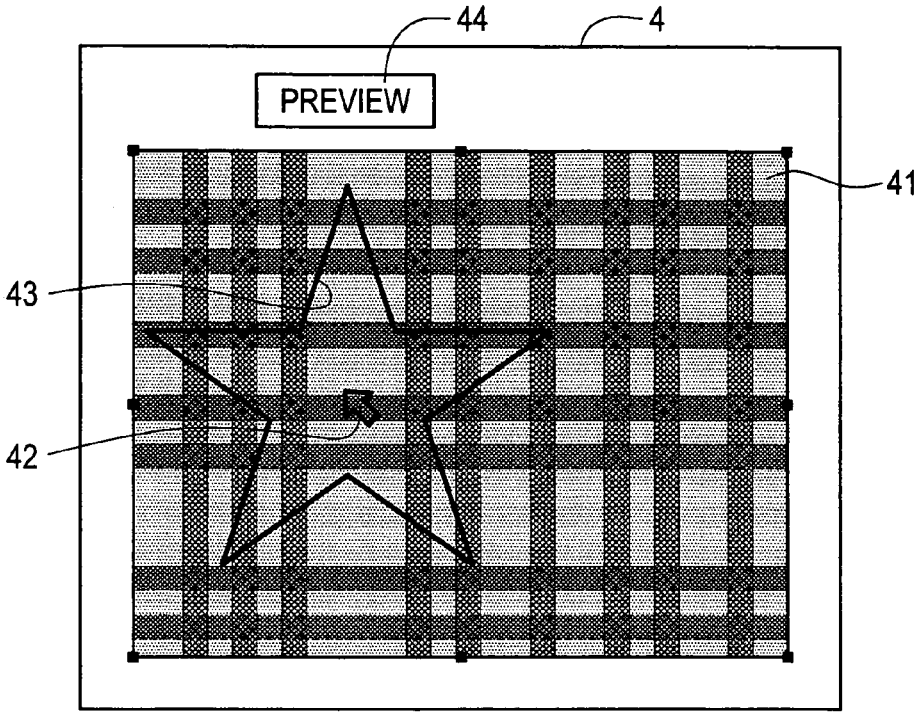
FIG. 5 is a diagram of an example of a display screen overlaying and displaying the fabric image for applique and an applique pattern.

In S103, as shown in FIG. 5, when the user manipulates the mouse 6, and moves the cursor 42 to the left side position in the center of vertical direction on the fabric image 41 displayed on the CRT display 14, and clicks by a specified number of times (for example, 2 times), the CPU 22 reads in the applique pattern 43 stored in the applique pattern storage area of the RAM 24, moves the center of applique pattern 43 nearly to the clicked position of the cursor 42, and overlays and displays the applique pattern 43 on the fabric image 41.

In S104, the CPU 22 reads in the size and the relative position of applique pattern 43 displayed on the fabric image 41, and stores in the RAM 24.

Figure 6:
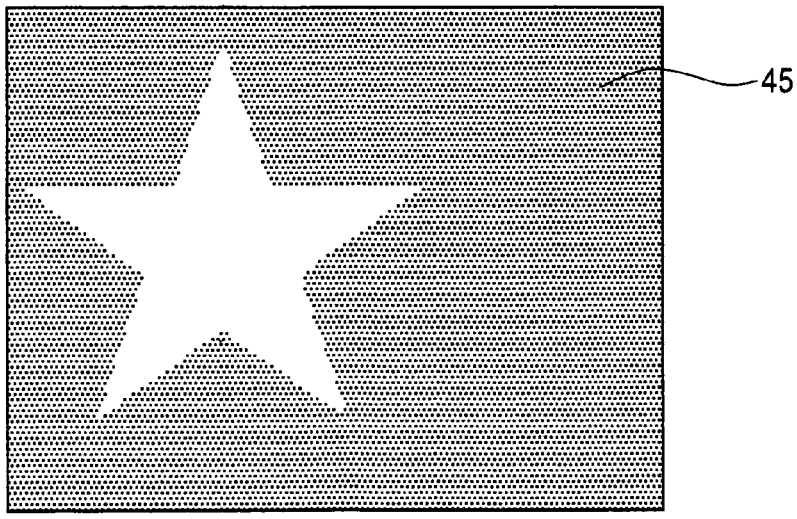
FIG. 6 is a diagram of an example of a masking image corresponding to the applique pattern shown in FIG. 5.

In S105, when the user manipulates the mouse 6, and moves the cursor 42 to the position of the preview button 44 and clicks, the CPU 22 reads out the size and the relative position of the applique pattern 43 on the fabric image 41 again from the RAM 24, and makes a masking image 45 so as not to display by covering the outer portion of the applique pattern 43 of the fabric image 41 as shown in FIG. 6, and stores in the RAM 24.

Figure 7:
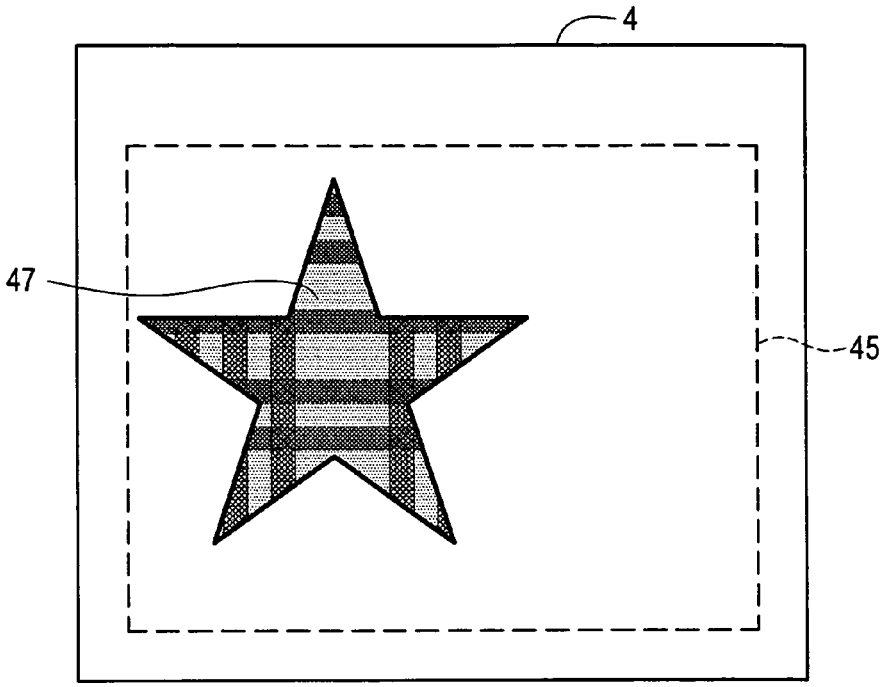
FIG. 7 is a diagram of an example of an applique image displaying the masking image overlaid on the fabric image in FIG. 5.

In S106, the CPU 22 overlays, as shown in FIG. 7, the masking image 45 on the fabric image 41 displayed on the CRT display 4, and displays the applique image 47 by extracting only the fabric image in the applique pattern 43.

In S107, the CPU 22 reads in the applique pattern 43 stored in the applique pattern storage area of the RAM 24, and creates sewing data for applique to be attached to the fabric by creating the applique fabric piece from the fabric for applique on the basis of this applique pattern 43, and stores in the RAM 24.

Figure 8:
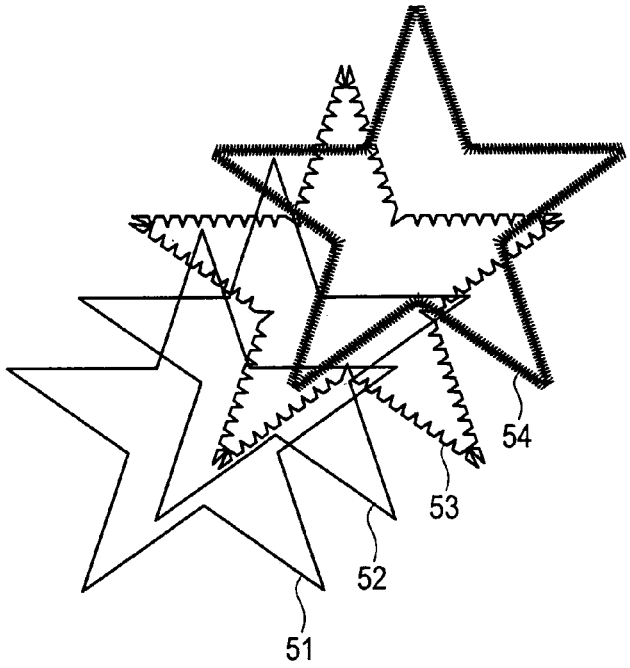
FIG. 8 is a diagram of an example of applique sewing data created on the basis of the applique pattern in FIG. 5.

As shown in FIG. 8, the applique sewing data comprises stitch data for applique cutting for forming applique cutting stitches 51 on the fabric for applique as target stitches for cutting the fabric for applique, stitch data for applique positioning for forming applique positioning stitches 52 on the fabric for applique as positioning stitches for gluing the cut applique fabric piece to the fabric, stitch data for applique mounting for forming applique mounting stitches 53 for mounting the applique fabric piece glued to the fabric on the fabric, and the stitch data for applique sewing for forming applique sewing stitches 54 for embroidering and sewing the applique fabric piece on the fabric by satin sewing stitches, etc.

Figure 9:
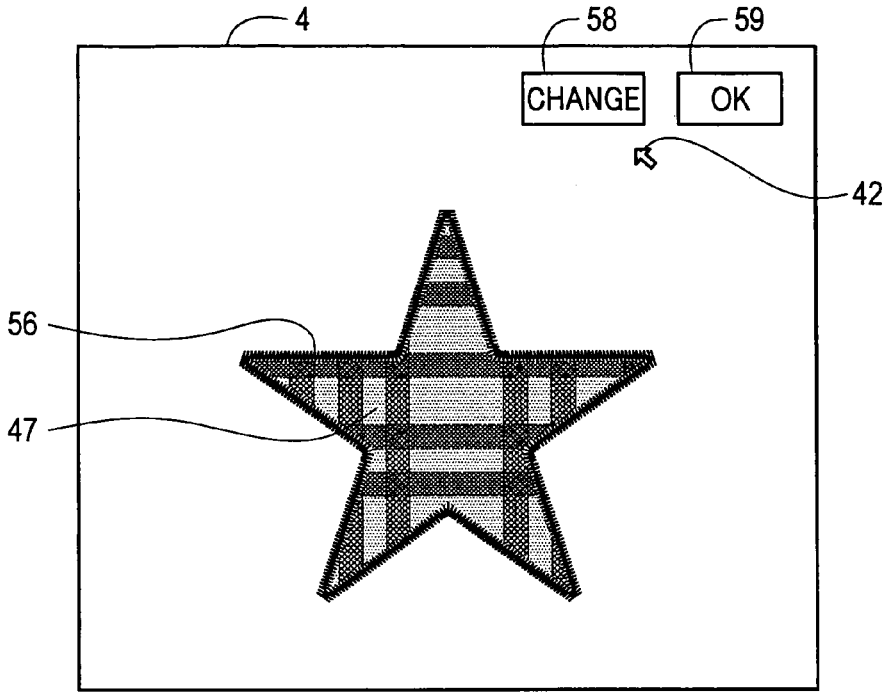
FIG. 9 is a diagram of an example of the display screen showing finished state of applique corresponding to FIG. 5.

In S108, as shown in FIG. 9, the CPU 22 displays an applique image 47 in the center of the CRT display 4. The CPU 22 reads out the applique sewing stitch data from the RAM 24, creates an applique sewing stitch image 56 showing applique sewing stitches 54, and displays the applique sewing stitch image 56 by overlaying on the applique image 47.

Further, the CPU 22 displays the change button 58 for instructing change of the applique image 47, and the OK button 59 for instructing end of the applique preview process, in the upper edge of the CRT display 4.

In S109, the CPU 22 judges whether the user has moved the cursor 42 to the position of the change button 58 and clicked or not by manipulating the mouse 6. When the user has moved the cursor 42 to the position of the OK button 59 and clicked by manipulating the mouse 6 (No in S109), the CPU 22 terminates this process and returns to the main flowchart.

When the user has moved the cursor 42 to the position of the change button 58 and clicked by manipulating the mouse 6 (Yes in S109), the CPU 22 executes the process after S101 again.

Figure 10:
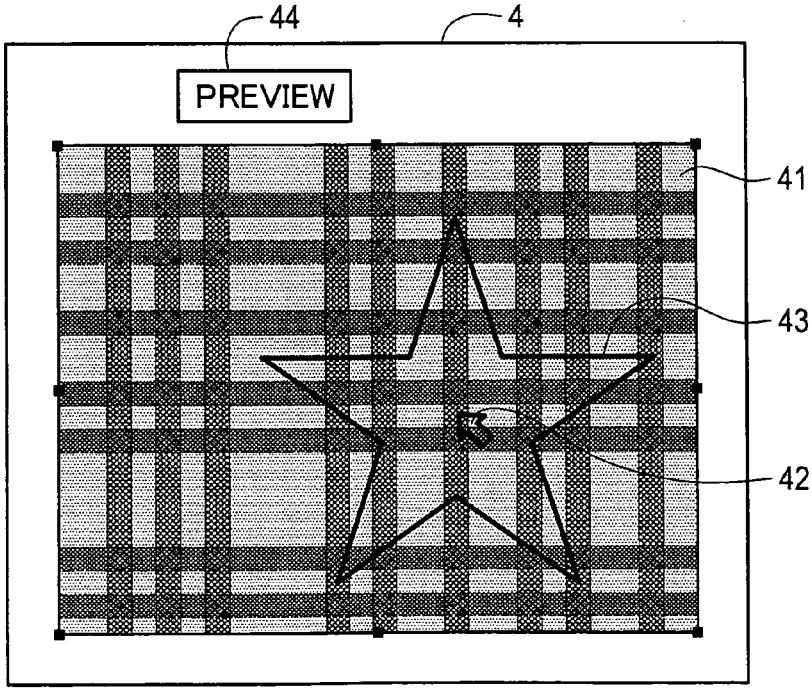
FIG. 10 is a diagram of an example of the display screen showing the applique pattern overlaid on other position of the fabric image of the fabric for applique.

For example, as shown in FIG. 10, in S103, if the user has manipulated the mouse 6 to move the cursor 42 to the lower right side in the center of the fabric image 41 displayed on the CRT display 4 and clicked by the specified number of times as specified, the CPU 22 reads in the applique pattern 43 stored in the applique pattern storage area of the RAM 24, and moves the center of the applique pattern 43 to the clicked position of cursor 42, and displays the applique pattern 43 by overlaying on the fabric image 41. In S104, the CPU 22 reads in the size and the relative position of the applique pattern 43 displayed on the fabric image 41, and stores in the RAM 24.

Figure 11:
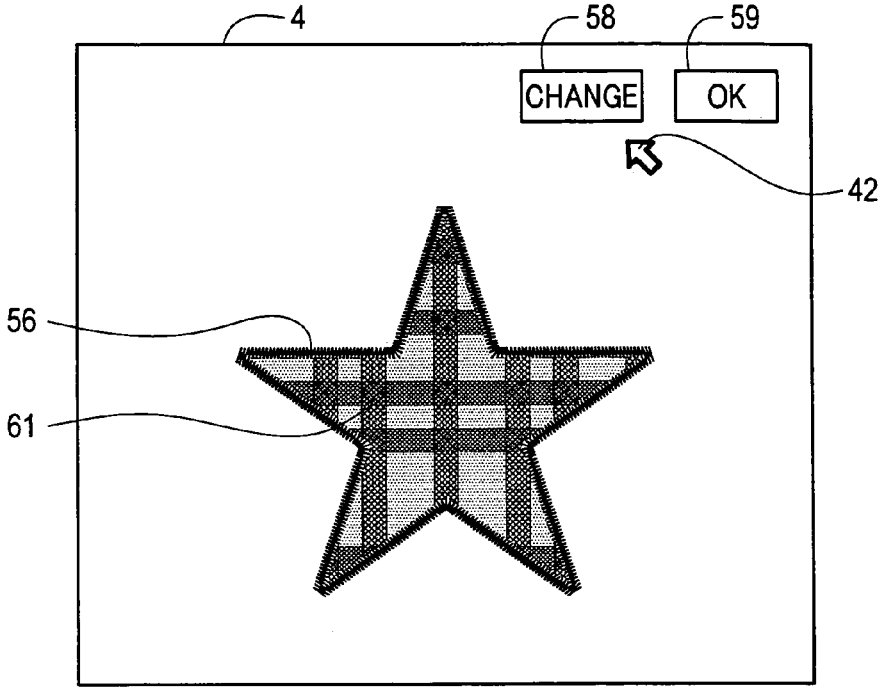
FIG. 11 is a diagram of an example of the display screen showing a finished state of applique corresponding to FIG. 10.

Next, as shown in FIG. 11, when the user has moved the cursor 42 to the position of the preview button 44 and clicked by manipulating the mouse 6, the CPU 22 executes the process from S105 to S108, and displays the applique image 61 formed of the fabric pattern at the lower right side in the center of the fabric image 41 in the center of the CRT display 4. The CPU 22 further reads out the applique sewing stitch data from the RAM 24, creates the applique sewing stitch image 56, and displays the applique sewing stitch image 56 by overlaying on the applique image 61.

Figure 12:
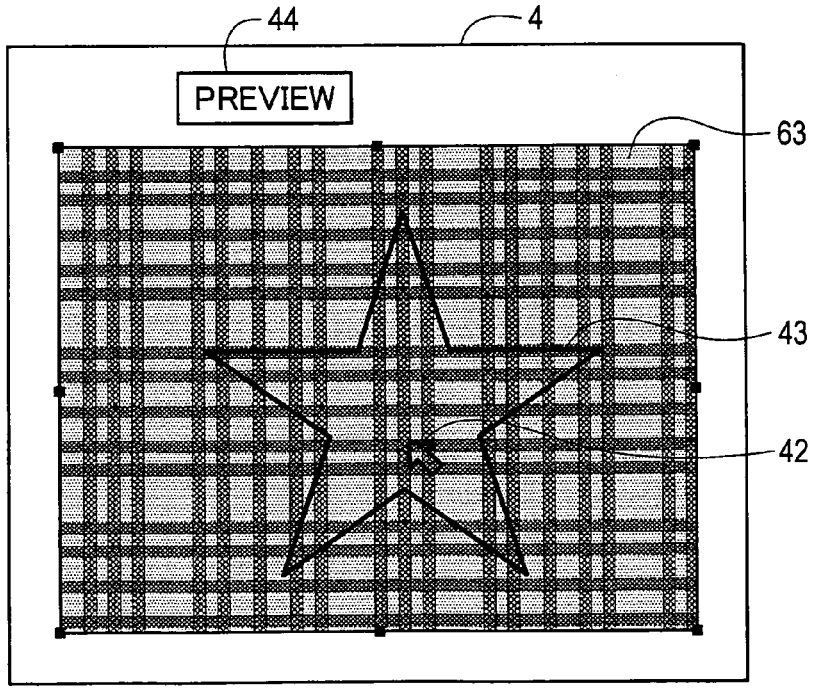
FIG. 12 is a diagram of an example of the display screen showing the fabric pattern of the fabric image of the fabric for applique in FIG. 5 by reduction to about ½ overlaid on the applique pattern.

Further, as shown in FIG. 12, in S102, when the user selects "holding of aspect ratio" on the size change window 35, selects side width "50%", and clicks the OK button 36, the CPU 22 sets the width size of the fabric image displayed on the display screen, corresponding to 2 times of width size displayed in the size display region 33, and displays the fabric image 63 of ½ scale (50%) of fabric pattern on the CRT display 4. In S103, when the user manipulates the mouse 6, and moves the cursor 42 to a slightly lower position of the center of the fabric image 63 displayed on the CRT display 4, and clicks by a specified number of times, the CPU 22 reads in the applique pattern 43 stored in the applique pattern storage area of the RAM 24, moves the center of the applique pattern 43 to the clicked position of the cursor 42, and displays the applique pattern 43 by overlaying on the fabric image 63. In S104, the CPU 22 reads in the size and relative position of the applique pattern 43 displayed on the fabric image 63, and stores in the RAM 24.

Figure 13:
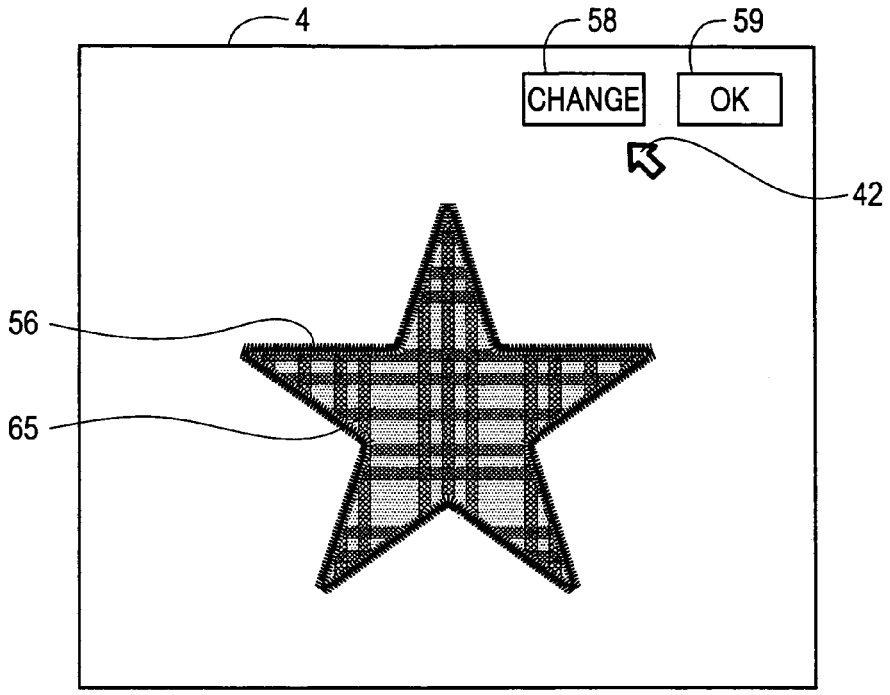
FIG. 13 is a diagram of an example of the display screen showing the finished state of applique corresponding to FIG. 12.

As shown in FIG. 13, when the user manipulates the mouse 6, and moves the cursor 42 to the position of the preview button 44 and clicks; the CPU 22 executes the process from S105 to S108, and displays the applique image 65 formed in the fabric pattern slightly lower at the lower side of the fabric image 63 nearly in the center of the CRT display 4. The CPU 22 reads out the applique sewing stitch data from the RAM 24, creates the applique sewing stitch image 56, and displays the applique sewing stitch image 56 by overlaying on the applique image 65.

As specifically described herein, in the embroidery data processing device 1 of the exemplary embodiment, the user selects the fabric image data of the fabric for applique by way of the fabric image selection window 31, and sets the scale of the fabric image to be displayed on the CRT display 4 by the size change window 35, and the selected fabric image. 41 of the fabric for applique is displayed. When the user manipulates the mouse 6, and moves the cursor 42 to the desired position of the fabric image 41 or the like, and clicks by a specified number of times, the applique pattern 43 preliminarily inputted through the image scanner 11 is displayed at the position of the cursor 42 (S101 to S103). When the user clicks the preview button 44 by the mouse 6, only the fabric image 41 within the applique pattern 43 is extracted, and applique images 47, 61, 65 are displayed, and applique sewing stitch image 56 is overlaid and displayed on the applique images 47, 61, 65 (S104 to S109).

Therefore, at the position specified by the mouse 6 of the fabric image 41 of fabric for applique or the like, a finished sewn state of applique fabric piece cut in applique pattern 43 is displayed, and the user can select various positions of the fabric for applique, and easily recognize the finished state of applique cut in applique pattern 43, and the user can easily make a comparative evaluation on the applique finished states created from a plurality of positions of the fabric for applique in the pattern fabric.

By the size change window 35, the user can easily change the display magnification rate of the fabric for applique, and can easily change the pattern of the fabric pattern of fabric for applique, and the user can easily obtain the images of finished state of the applique fabric piece different in size and position of the fabric pattern.

By the fabric image selection window 31, the user can obtain displays of finished state of the applique fabric piece cut in the inputted applique pattern 43 in each one of a plurality of types of the fabric for applique, and the user can easily make a comparative evaluation on the finished states of the applique patterns created from the plurality of types of the fabrics for applique.

The invention is not limited to the foregoing exemplary embodiment alone, but may be modified within a scope not departing from the essential characteristics thereof.

Figure 14:
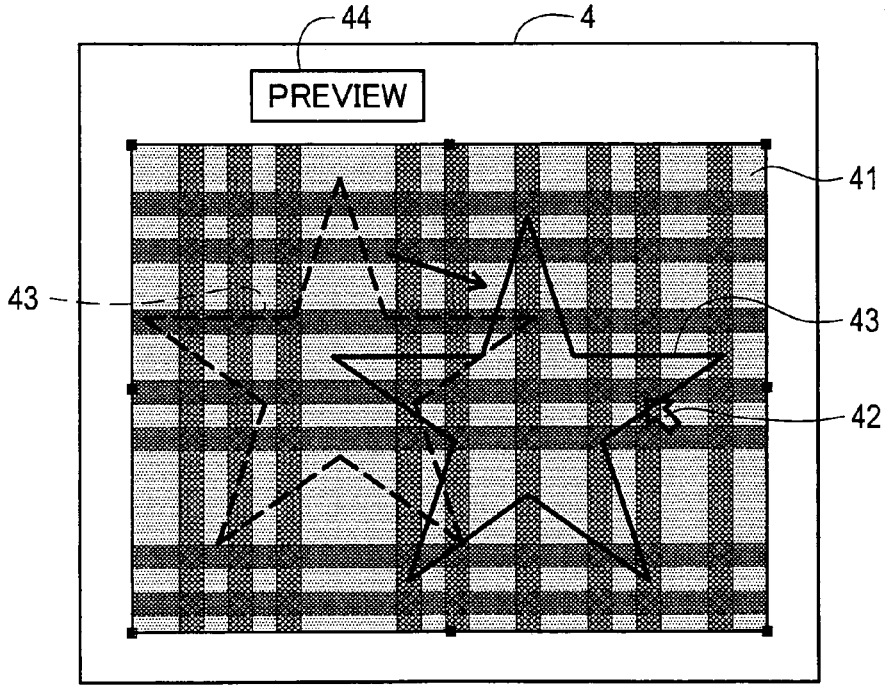
FIG. 14 is a diagram of an example of dragging, by using a mouse, the applique pattern on the fabric image of the fabric for applique in the embroidery data processing device in another exemplary embodiment.

(A) For example, as shown in FIG. 14, at S103, the applique pattern 43 shown in FIG. 5 is dragged and moved by using the mouse 6, and the applique pattern 43 is displayed at the moved position. In the process from S104 to S108, at the moved position of the applique pattern 43, the applique image may be created and displayed.

As a result, the user can easily change the cutting position of the fabric for applique in the applique pattern 43, and easily obtains images of finished state of the applique fabric piece created from the desired portion of the fabric for applique such as the pattern fabric.

(B) In the exemplary embodiment, the applique pattern 43 is inputted through the image scanner 11, but a plurality of applique patterns may be stored preliminarily in the ROM 23, and a desired applique pattern may be selected from the plurality of applique patterns, and overlaid and displayed on the fabric image 41.

While the presently exemplary embodiment of the disclosure has been shown and described, it is to be understood that this disclosure is for the purpose of illustration and that various changes and modifications may be made without departing from the scope of the invention as set forth in the appended claims.

What is claimed is:

1. An embroidery data processing device comprising:

a shape input device that inputs an applique pattern;

an applique sewing data creating device that creates applique sewing data for sewing applique of the applique pattern on a fabric;

a fabric image data input device that inputs fabric image data of the fabric for the applique;

a fabric image display device that displays a fabric image on the basis of the fabric image data inputted by the fabric image data input device;

an applique pattern display device that overlays and displays the applique pattern on the fabric image; and an applique image display device that extracts only the fabric image within the applique patterned overlaid on the fabric image out of the fabric image and displaying as an applique image, and displays an applique stitch image for sewing the applique on the basis of the applique sewing data by overlaying on the applique image.

2. The embroidery data processing device according to claim 1, wherein the fabric image display device includes:

a display magnification factor change device that changes the display magnification factor of the fabric image.

3. The embroidery data processing device according to claim 1, further comprising:

a fabric image data storage device that preliminarily stores the fabric image data of a plurality of types of the fabrics for the applique; and a selecting device that selects one of the fabric image data out of the fabric image data of the plurality of the types of the fabrics for the applique, wherein the fabric image display device displays the fabric image on the basis of the fabric image data selected by the selecting device.

4. The embroidery data processing device according to claim 1, further comprising:

a relative position specifying device that specifies the relative positions of the fabric image and the applique pattern inputted by the shape input device on the fabric image, wherein the applique image display device extracts the fabric image on the basis of the relative positions specified by the relative position specifying device and the applique pattern.

5. The embroidery data processing device according to claim 4, further comprising:

a relative position changing device that changes the relative position specified by the relative position specifying device, wherein the applique pattern display device displays the applique pattern by moving to the relative position on the fabric image changed by the relative position changing device.

6. A computer program product used and executed in an embroidery data processing device comprising:

a computer readable recording medium; and a computer program stored in the computer readable recording medium, wherein the computer program includes:

a shape input step of inputting an applique pattern;

an applique sewing data creating step of creating applique sewing data for sewing applique of the applique pattern on a fabric;

a fabric image data input step of inputting fabric image data of the fabric for the applique;

a fabric image display step of displaying a fabric image on the basis of the fabric image data inputted in the fabric image data input step;

an applique pattern display step of overlaying and displaying the applique pattern on the fabric image; and an applique image display step of extracting only the fabric image within the applique patterned overlaid on the fabric image out of the fabric image and displaying as an applique image, and displaying an applique stitch image for sewing the applique on the basis of the applique sewing data by overlaying on the applique image.

7. The computer program product according to claim 6, wherein the fabric image display step includes:

a display magnification factor change step of changing the display magnification factor of the fabric image.

8. The computer program product according to claim 6, wherein the computer program further comprises:

a fabric image data storage step of preliminarily storing the fabric image data of a plurality of types of the fabrics for the applique; and a selecting step of selecting one of the fabric image data out of the fabric image data of the plurality of the types of the fabrics for the applique, and the fabric image display step displays the fabric image on the basis of the fabric image data selected in the selecting step.

9. The computer program product according to claim 6, wherein the computer program further comprises:

a relative position specifying step of specifying the relative positions of the fabric image and the applique pattern inputted in the shape input step on the fabric image, and the applique image display step extracts the fabric image on the basis of the relative positions specified in the relative position specifying step and the applique pattern.

10. The computer program product according to claim 9, wherein the computer program further comprises:

a relative position changing step of changing the relative position specified in the relative position specifying step, and the applique pattern display step displays the applique pattern by moving to the relative position on the fabric image changed in the relative position changing step.

* * * * *